US008673032B2

(12) United States Patent
French et al.

(10) Patent No.: US 8,673,032 B2
(45) Date of Patent: Mar. 18, 2014

(54) METHOD OF MANUFACTURING COKE FROM LOW GRADE COAL

(75) Inventors: Robert French, Wellington, CO (US); Robert A. Reeves, Arvada, CO (US)

(73) Assignee: GTL Energy Holdings Pty Limited (AU)

( * ) Notice: Subject to any disclaimer, the term of this patent is extended or adjusted under 35 U.S.C. 154(b) by 0 days.

(21) Appl. No.: 13/441,738

(22) Filed: Apr. 6, 2012

(65) Prior Publication Data

US 2012/0255224 A1 Oct. 11, 2012

Related U.S. Application Data

(60) Provisional application No. 61/472,314, filed on Apr. 6, 2011.

(51) Int. Cl.
*C10L 5/00* (2006.01)

(52) U.S. Cl.
USPC ..... 44/607; 44/591; 44/592; 44/593; 44/594; 44/595; 44/596; 44/597; 44/598; 44/599; 44/608; 44/620

(58) Field of Classification Search
USPC ..... 44/591–599, 607, 608, 620
See application file for complete search history.

(56) References Cited

U.S. PATENT DOCUMENTS 3,560,346 A * 2/1971 Gunter ..... 201/6

* cited by examiner

*Primary Examiner* — Cephia D Toomer
(74) *Attorney, Agent, or Firm* — Sheridan Ross P.C.

(57) ABSTRACT

The present invention provides methods of transforming low rank coals into high quality metallurgical coke, and the coke products produced by such methods.

57 Claims, 8 Drawing Sheets

METHOD OF MANUFACTURING COKE FROM LOW GRADE COAL

CROSS REFERENCE TO RELATED APPLICATIONS

The present application claims the benefit of U.S. Provisional Application No. 61/472,314, filed Apr. 6, 2011, the entire contents of which are hereby incorporated herein by this reference.

FIELD OF THE INVENTION

The invention relates to a method of briquetting and carbonizing low rank coals (LRCs) to produce high quality coke products.

BACKGROUND

Many industries utilize high carbon materials, commonly referred to as coke, to make a variety of products, including steel and other metals. To be utilized, coke must meet rigorous physical and chemical specifications for moisture, volatiles, ash, sulfur, phosphorous, alkalies, and carbon content. Production of coke requires the carbonization of coal through pyrolization, a thermal process. It is typically a time consuming and expensive process.

Cheaper coals, commonly referred to as low rank coals (LRCs), which include, for example, brown coal, lignite, and subbituminous coal, have been unsuitable for producing coke. This is primarily due to their low thermal values, which are primarily a reflection of their high moisture content, and lack of agglutinating properties making them unsuitable for the production of coke. This being so, low volatile bituminous coals (LVBs), rather than LRCs, have historically been used as feedstock for coke production. Because no single type of LVB has the requisite chemical and physical specifications to serve as a feedstock, a blend of prepared LVBs must typically be used to produce coke. Given the limited resources and relative costliness of LVBs as compared with LRCs, there is a need for developing a method for using a more cost effective source of coal, such as LRCs, rather than LVBs in the production of coke.

Existing methods of coke production are time consuming and inefficient. Traditionally, producing coke requires four separate batch operations: (1) blending of a variety of raw or prepared LVBs (2) charging a slot oven, (3) heating the charge at a high temperature throughout the 'coking' period, (4) pushing hot coke from the oven onto a wharf to cool. These operations normally require more than 15 hours to complete. Efficiency and throughputs are constrained by the quality of the feedstock, especially particle size, bulk density, and coking properties such as swelling, softening, and solidification. Hence, there is a need in the industry for developing a more efficient, less time consuming, and cheaper method of producing coke.

Methods of coke production are also historically associated with high environmental costs. Coke production requires the pyrolization of the carbonized materials through a thermal process. Such thermal processe typically produces significant organic vapors that escape into the atmosphere during the coking cycle. Costly environmental controls are required to capture and treat these to meet environmental regulations. Hence, there is a need in the industry for a method of producing coke that does not expose hot coke or release organic vapors to the atmosphere.

SUMMARY

These and other needs are addressed by the various aspects, embodiments, and configurations of the present disclosure which generally relate to methods of briquetting and carbonizing low rank coals (LRCs) to produce high quality metallurgical coke products, and the products produced by these methods.

This invention describes a method for utilizing low-cost LRCs, rather than more costly LVBs, to inexpensively and efficiently produce high-quality coke for use in metallurgical and other processes. The method employed to transform LRCs into coke is faster, less expensive, and more environmentally sound than traditional coke making methods.

LRC may first be transformed into a briquette through various embodiments of the invention, including one or more of: crushing the LRC feedstock, beneficiating the materials if required, compacting the crushed and/or beneficiated materials using a mechanical compactor, drying the compacted material at relatively low-temperatures, and pressing the compacted and dried products to form LRC briquettes. The LRC feedstock is typically at a temperature between 5° C. (41° F.) and 40° C. (104° F.) as it undergoes the compaction process. The dryer that is used in a typical embodiment of the invention need only heat the material to a temperature between about 25° C. (77° F.) and about 66° C. (150° F.) to dry the LRC material.

The invention also provides methods of carbonizing LRC briquettes to transform them into coke. In one embodiment of the invention, LRC briquettes are fed through a lock hopper device and into a special low-temperature rotating pyrolysis module that carbonizes the LRC briquettes at a temperature of less than about 750° C. (1,382° F.). Offed vapors, dusts, and fines, may be used to fuel the pyrolysis module and either reintroduced into the pyrolysis process or sent to a by-product recovery plant. Because LRCs naturally contain more volatile matter than LVBs by-product recovery from these coke making processes are much more economically advantageous than in traditional coke making processes. Finally, because the compaction processes of the present invention compact macerals of organic materials together mechanically, there is no requirement to add glutins or any other binders to form briquettes. Further, compacting macerals or organic materials together prior to carbonization replaces the need to use LVBs that must have agglutination properties. Eliminating the use of glutins, or any other binders, and elimination of the requirement to use expensive LVBs that have agglutinating and other coking properties, reduces the cost of producing coke by the methods of the present invention.

After pyrolysis is complete, the coke briquette products may then be transmitted to a cooling module. In a preferred cooling module, the briquettes are passed across, and come into contact with, cool tubes multiple times, and are also fanned by recirculating inert gases cooled by a heat exchanger. The coked product, cooled in this manner without exposure to the environment, is then discharged as a cooled LRC coke briquette that does not emit significant organic vapors into the atmosphere.

Carbonization by the continuous methods of this invention can be accomplished in less than 3 hours, in sharp contrast to traditional batch coke-making methods that normally take more than 15 hours to complete.

LRC coke briquettes produced by this invention are physically different from, and superior to, traditional coke in many ways. In these processes, the LRC coke briquettes may be shaped and sized according to the requirements of the intended application. Additionally, LRC coke briquettes may be produced with a high coke strength after reaction (CSR).

Carbon is the principal component in coke. Coke made in the traditional way contains closed cells that are created during devolatilzation. As a result, a significant amount of coke will float on water. The low density limits the amount of carbon in a given volume of traditional coke. Coke made by the present invention, on a volume basis, contains more carbon than traditional coke. The carbon content in LRC coke briquettes produced by the methods of this invention is typically 10% to 20% higher by volume (i.e., apparent density), or typically 3% to 5% higher by weight (i.e., weight percent), than the carbon content of coke products made by traditional coke making processes.

Some benefits of the processes of the present invention include:

1. Enabling the use of low-cost, LRC feedstocks in the production of high-quality coke.
2. Continuous processing from LRC briquette feedstock to LRC coke briquette, particularly through the pyrolysis and cooling modules.
3. Low temperature drying of the LRC compacts.
4. Low temperature pyrolysis of the LRC coal briquettes.
5. Greatly reduced pyrolysis processing time when compared to pyrolysis procedures used in traditional coke making.
6. Improved heat transfer rate from the pyrolysis machinery to the LRC briquettes.
7. Control over the LRC briquettes results in the ability to select a desired coke briquette product size and shape.
8. Reduced emissions made possible by cooling the LRC coke briquettes to near ambient temperatures, in an enclosed module, prior to exposure to the atmosphere.
9. Increased by-product recovery made possible by use of high volatile content LRC feedstock and reduced use of fuel to achieve lower pyrolysis temperatures than that required by traditional coke making methods.
10. The production of high coke strength after reaction (CSR) coke briquettes.

BRIEF DESCRIPTION OF THE DRAWINGS

The accompanying drawings are incorporated into and form a part of the specification to illustrate several examples. These drawings, together with the description, explain the principles of various embodiments of the present disclosure. The drawings simply illustrate preferred and alternative examples of how various embodiments can be made and used and are not to be construed as limiting the claimed subject matter to only the illustrated and described examples.

DETAILED DESCRIPTION

The present invention provides a method for transforming carbonaceous material into metallurgical coke, and the coke products produced by such methods.

Carbonaceous Material Feedstocks

The present invention processes LRCs that are normally devoid of coke making characteristics, as opposed to low-volatile bituminous (LVB) coals used in traditional coke production methods. The material processed by the present invention includes LRCs such as brown coal, lignite, and subbituminous coal. These types of carbonaceous materials, as utilized in the present invention, are widely produced throughout the world, and are inexpensive to mine. Coking properties of the feedstocks used are not important because the briquetting process described by this invention replaces them. This benefit enables LRCs, a widely available and economically attractive resource, to be a suitable feedstock for making coke.

The feedstock LRCs useful in the methods of this invention are selected or processed to contain sufficiently low ash and phosphorous to make coke of the desired quality, just as is true of LVBs used in traditional coke making. In typical embodiments, the ash content in the LRC feedstock may be less than 12 wt %, and the phosphorous content less than 0.01 wt %, more preferably less than 0.005 wt %, or the LRCs will need to be beneficiated to such proportions through beneficiation processes described below. Pyrolysis does not remove these constituents from the feedstock. Instead, ash and phosphorous, when expressed as weight percentages of the feedstock, are concentrated when water and volatile matter are removed.

Figure 1:
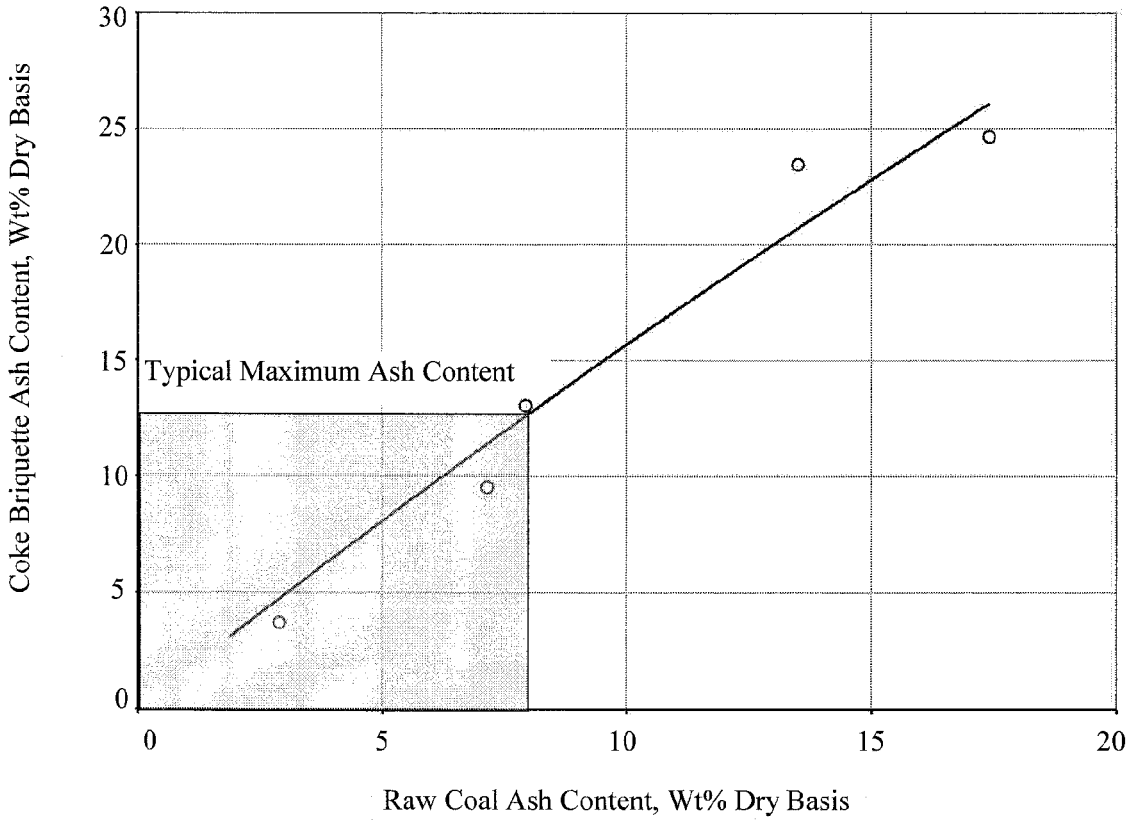
FIG. 1 describes the relationship between the ash content in a typical sample of raw LRC versus the ash content in coked LRC products of the present invention.

FIG. 1 shows the relationship between the feedstock ash concentration in typical LRC feedstocks embodied by this invention and the ash concentration in coke produced by the methods described in this invention. The relationship is nearly linear across a wide range of ash contained in LRC sourced in the northern and southern hemisphere. Many LRCs, especially those found in New Zealand, Indonesia, Australia, and Wyoming, USA, are chemically suited to the coke-forming processes of the present invention, e.g., low ash, sulfur, sodium, and phosphorous. Low-ash Australian brown coal obtained from the Latrobe Valley, Victoria, is especially amenable to forming coke by the methods of the present invention.

Moisture is the dominant component in LRCs, ranging between 28% and 65% by weight and retained as:

(1) 'free' water that is present on the exposed surfaces of the LRC particles from where it is easily removed by evaporation;

(2) 'contained' water present in unexposed pores and interstices which is liberated to form more 'free' water, as described by this disclosure;

(3) 'bonded' water that is present in organo-chemical compounds and is normally released only when the LRC is subjected to high temperature processes.

Both the free and contained moisture, which is liberated by the methods of the present invention, are released at temperatures below 66° C. (150° F.). Typically, the raw LRC feedstocks utilized in the processes of this invention contain between about 28 wt % moisture and about 65 wt % moisture, and preferably contain about 35 wt % moisture.

LRC Briquetting Process

Figure 2:
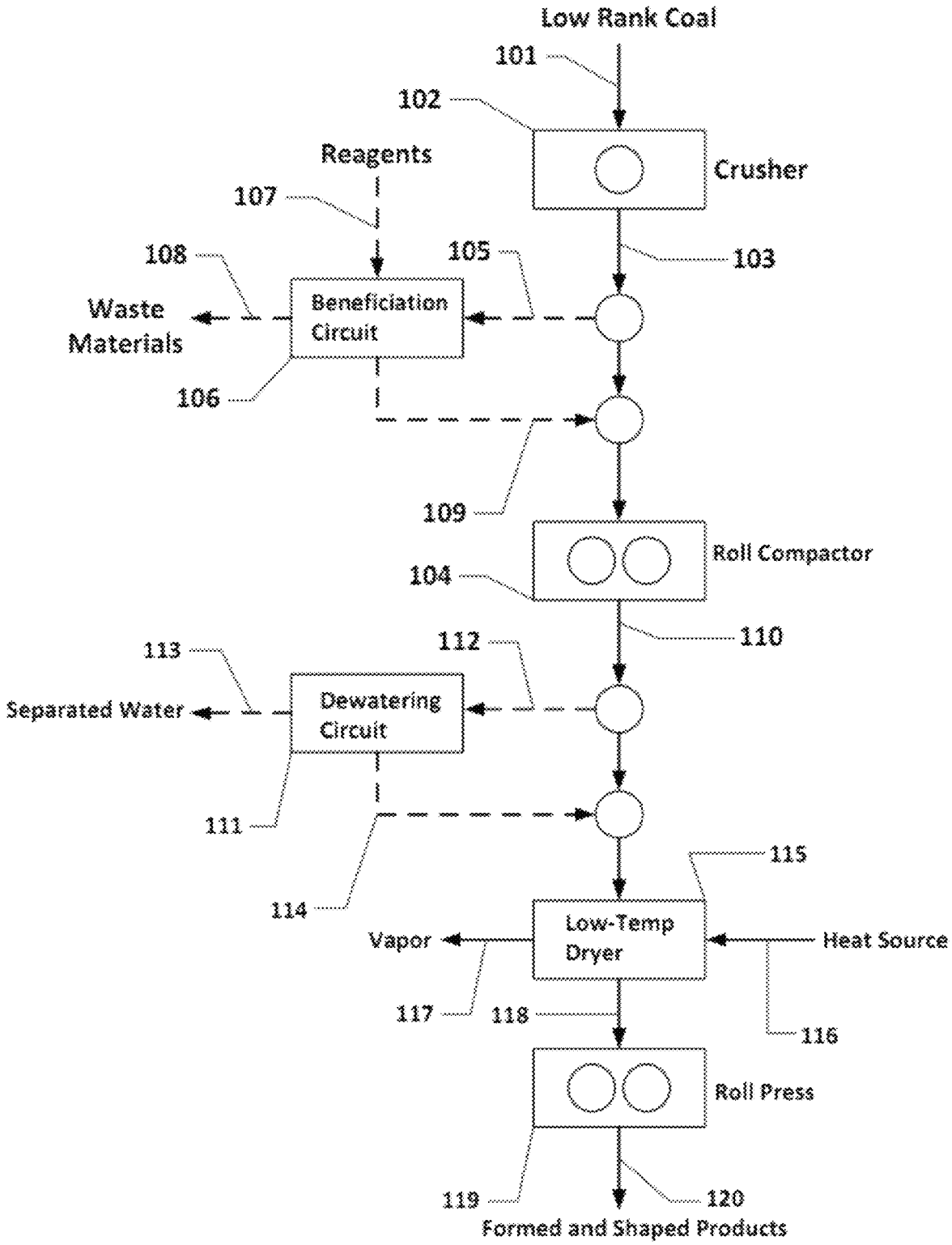
FIG. 2 describes a method of one embodiment of the present invention, which includes comminuting, beneficiating, compacting, drying and pressing LRCs into briquettes.

In one embodiment of the present invention illustrated in FIG. 2, a raw carbonaceous material (101) that may include one of brown coal, lignite, subbituminous coal, and combinations thereof, together referred to as low rank coals, ("LRCs"). Preferably, the temperature of the raw LRC is between about 5° C. (41° F.) and about 40° C. (104° F.), and more preferably the raw LRC is at ambient temperature. LRC is often mined and crushed to approximately 50 mm (2 in) top size, a size typically traded worldwide. In one embodiment of the present invention, raw LRCs of up to 50 mm (2 in) in size may be comminuted in a crusher (102) to produce a crushed product (103). The product may be crushed using any suitable device. In one preferred embodiment, at least one of a hammer mill and a roll crusher, comminutes the LRC of approximately minus-50 mm (2 in) size down to approximately 5 mm (0.2 in), though in some embodiments the product may be larger. The optimum particle size of the crushed product required to provide the desired compaction properties is experimentally determined for a particular application and feed source. In some embodiments, the comminuted LRC may have a top size that varies between about 0.2 mm (0.04 in) and about 19 mm (0.74 in). More preferably, the top size of the crushed LRC is about 5 mm (0.2 in). The processes of the present invention may be used to process all of the feed material, thus achieving greater recovery of resources than other drying techniques that burn, remove and potentially discard finely sized materials prior to processing.

If the LRC material requires upgrading to provide a material of a specified chemical composition for further processing in the methods of the present invention, the LRC material (105) may optionally be diverted to a beneficiation circuit (106). In some embodiments, these optional beneficiation processes may include upgrading the crushed product (105) by one or more methods including, but not limited to, gravity separation, ion exchange and/or leaching methods. In one embodiment, a gravity circuit utilizing any one of a concentrating table, jig, spiral concentrator, heavy media cyclone, and heavy media vessel, and combinations thereof, and reagents which may include one of magnetite or other gravity control reagents, and combinations thereof, raises the specific gravity to separate out undesirable materials including any one of ash, pyrite, other minerals, and combinations thereof, from the remaining LRC material.

In another embodiment, the beneficiation circuit (106) may include an ion exchange method to reduce certain element concentrations such as sodium. Reagents (107) utilized in some embodiments of ion exchange may include one of calcium hydroxide, calcium carbonate, flue gas desulfurization sludge, other alkaline-rich substances that may exchange one ion in the LRC for another ion in the reagent mixture, and combinations thereof In another embodiment, a beneficiation circuit (106) may include a leaching circuit to reduce certain element concentrations including one of sodium, ash, sulfur, and combinations thereof Reagents (107) utilized in some embodiments of a leaching circuit may include sulfuric acid, hydrochloric acid, nitric acid, acetic acid, sodium hydroxide solution, other aqueous material that has a pH of less than 7, and combinations thereof. Wastes (108) produced by the beneficiation circuit (106) may be discarded, or used in other, unrelated processes.

The processing of the LRC feedstock includes compacting the LRC material in a compactor. The LRC feedstock having a suitable size for the compaction machinery (as crushed by the crushing processes described above, or as supplied directly from a mining operation) is compacted using an applied mechanical force sufficient to deform the feedstock to reduce the volume of pores and interstices. Preferably, the force applied may be in the range of between 352 kg-force/$cm^2$ and 3,520 kg-force/$cm^2$ (5,000 lbf/$in^2$ and 50,000 lbf/$in^2$), and more preferably the applied force may be about 2,110 kg-force/$cm^2$ (30,000 lbf/$in^2$).

Any compaction machinery capable of continuous processing at these compaction pressures may be used for the compacting. Preferably, a roller press is used to compact the feed material. In one embodiment, preferred roller press rolls for use in compaction processes of the present invention have a specific design that delivers higher capacity and lower energy consumption than smooth rolls of conventional roller press roll design.

Thus, in the embodiment depicted in FIG. 2, the feed material is fed to a compaction roll press (104) that exerts high pressures on the feed material. The material is physically transformed under pressure to collapse the porous structures that are present in LRCs. The pores and interstices within the feed material harbor 'contained' water, and when collapsed under pressure, force the majority of the contained water to the surface of the LRC feed material. In certain embodiments, the resulting surface water may be removed from the compacted LRC (110) in a dewatering circuit (111) by mechanical means including one of centrifuges, belt filter presses, other types of mechanical dewatering equipment, and combinations thereof. Removing a portion of the water by mechanical means greatly reduces the energy that would otherwise be required to evaporate the water with heat. Separated water (113) produced by the dewatering circuit may be treated to make it suitable for disposal.

More effective compaction of the feed material occurs if the feed material resides in the compaction zone of a roll press for an extended period. Therefore, in one embodiment of the invention, compaction rolls are used that provide longer compaction time because their profile design exerts high compaction forces over a wide arc of rotation. In this embodiment, two identical counter-rotating rolls are used in the roll press, each roll having an undulating peripheral surface that rotates in a timed, peak-to-valley process to provide highly-effective compaction, high production rates and low specific energy consumption. More effective compaction occurs as the material resides for a relatively long time as the undulating surface of the rolls rotate through a rotation arc in a manner timed to interlock peak-to-valley.

Preferred roll profiles that holds the feed material in the compaction zone for an extended period of time, are described in co-pending U.S. Patent Publication No. 2009-0158645-A1.

The tangent segments of these rolls exert high compaction forces onto the feed material in directions perpendicular to the angle of the tangent segments. This method of applying compaction forces minimizes slippage between the roll and material during compaction because frictional forces play only a minor part in propelling the material through the compaction zone, resulting in lower specific energy consumption and higher compaction forces. These energy and force profiles are in direct contrast to the energy consumption and compaction forces developed with the use of smooth rolls. In the case of smooth rolls, the feed material must be engaged by frictional forces developed between the material and smooth roll face to drag the material trough the compaction zone. This often results in slippage between the roll and feed material and compaction occurs during a relatively small angle of rotation due to the geometry of the two smooth rolls when they are in close proximity to one another. Similarly, rolls with a corrugated profile (i.e. rolls that do not have a straight tangent segment between ridges and valleys on the roll profile) are not effective because the compacted material varies in thickness due to the geometry of the rolls when they are in close proximity to one another.

Using these preferred roll press rolls, the energy requirement of the compaction step is greatly reduced over the energy required to effect the same or similar compaction using smooth rolls in a conventional roll press. The energy savings can be a great as 50%. In the roll press machinery, a screw may be used to pre-compact the crushed material into the rolls of the roll press, thereby guiding crushed feed into the rolls for compaction. The energy utilized to drive the screw of the roll press associated with the rolls of a roll press of the present invention is significantly reduced compared to the energy utilized to drive the screw of a conventional roll press using the same feed material. This reduced energy utilization for driving the screw of the roll press results in great energy savings in operating a roll press utilizing rolls in the design of the present invention. This energy savings will overcome the increased energy that may be required to drive the rolls of the roll press of the present invention, as compared to the energy required to drive the rolls of a conventional roll press.

The compacted LRC material (110), (114) is dried to remove free water and contained water (originally present in the LRC but driven to the surface of the compacted LRC by the compaction process). The compacted LRC is amenable as feed for an indirect low-temperature dryer (115). Thus, in one embodiment of the invention, a low-temperature dryer provides indirect low temperature heat to dry the compacted LRC. In one embodiment, the low-temperature dryer is an indirect rotary dryer, which dries the compacted product to the desired total moisture content that meets the specifications for carbonization. In such a dryer, the source of heat (116) or working fluid may include one of hot water, flue gas from a combustion process, steam, air or gas supplied from electric heaters, and waste heat available from existing industrial processes such as power plants, other form of hot material, and combinations thereof. The dryer evaporates a portion of the 'free' water contained in the compacted LRC to make a vapor (117), which may be vented to the atmosphere, or sent to another device that can treat the vapor.

Figure 3:
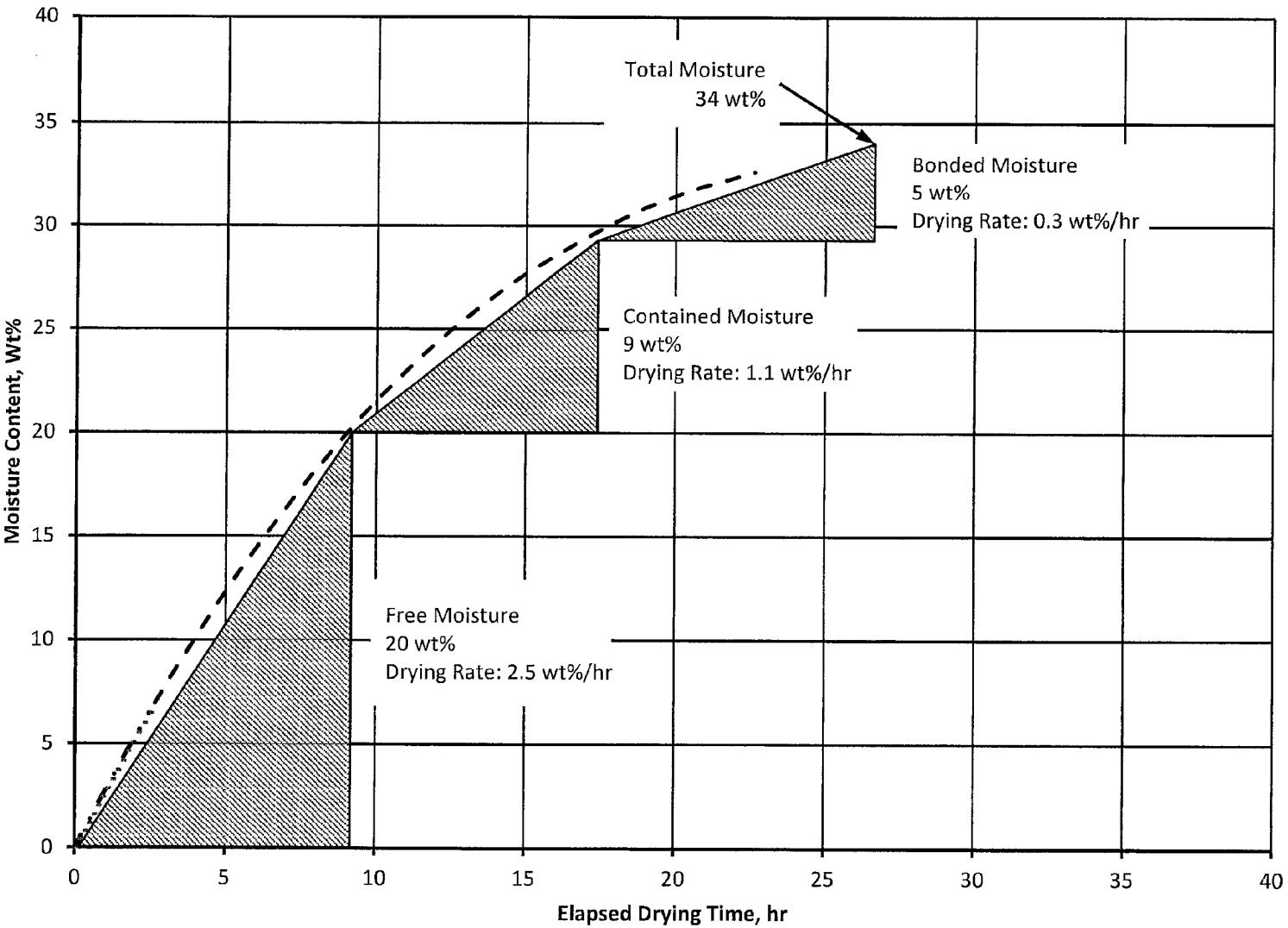
FIG. 3 describes average distribution ratios and drying rates of total moisture in typical LRCs of the present invention.

Drying rates of crushed and compacted LRC may be greater than drying rates of the raw carbonaceous material before compaction. The reason for the increased drying rate is that the 'free' and formerly 'contained' water, which has been expressed from the pores and interstices of the crushed and compacted product, is in direct contact with a working fluid passing over the product. Increasing drying rates at low temperatures provide the operator with several benefits not offered by traditional high-temperature drying processes. For example, smaller and less costly equipment may be used to achieve the desired capacity. If costs do not constrain the operation, greater capacity may be achieved with compaction. Lower working temperatures may be used to dry heat-sensitive materials, thereby avoiding or substantially reducing oxidation and product deterioration. Reducing oxidation greatly improves coke quality. In a preferred embodiment of the invention, lower working temperatures, between about 43° C. (110° F.) and about 66° C. (150° F.), preferably about 49° C. (120° F.), allows the 'free' water to be removed without changing the molecular structure of the LRC, the composition of the ash or the solid volatiles. Average distribution ratios and drying rate of total moisture in some types of LRCs contemplated by this invention are illustrated in FIG. 3, although this may vary depending on the diverse organic origins, depositional environments, and maturation processes of the LRC feedstock materials utilized.

Traditionally, carbonaceous materials used for the production of coke are dried at higher temperatures than contemplated by the present invention. At such higher temperatures, vapor, containing the fluid removed by evaporation, often contains dust that must be collected and thermally treated to meet environmental regulations. Experiments by the present inventors have confirmed that the vapor produced during the low-temperature drying methods of the present invention does not contain significant organic vapors that require additional collection or thermal treatment. Thus, substantial cost savings result from the drying method employed in the present invention. In one embodiment of the invention, collected dust and fines may be introduced, or reintroduced, to the compaction operation to increase product yield, thereby also reducing costs.

Referring again to the embodiment depicted in FIG. 2, the dried compacts formed from the LRC starting materials (119) are protected by directing them into a press (120) equipped with rolls that contain a specified pocket design that form a shaped product (121) that meets the specifications for carbonization. A press shapes the product (121), into LRC coal briquettes that can be readily handled, stored, and transported by rail or shipped to distant users. The LRC coal briquette (121) may be sized or shaped to mitigate degradation during processing. Additionally, the size of the LRC coal briquette affects the heating rate of the LRC coal briquette during subsequent pyrolysis to form LRC coke briquettes.

Carbonization Process

The methods of the present invention may achieve much higher heating rates (up to 10 times faster) than that possible with traditional coke making practices for four reasons that relate to heat transfer by conduction, convection, and radiation. First, as described below, heating in the pyrolysis module occurs in a slowly rotating, indirectly heated vessel. Efficient heat transfer occurs when the briquette's cooler surfaces are continuously coming into contact with a hot surface. The rate of transfer is directly proportional to the difference in temperature between the hot and cooler surface. Coal feedstock materials are not agitated in traditional coke making practices and the heat transfer rate is therefore slower as charge and the furnace wall temperature become almost equal. Unlike traditional batch operations in which cool feedstock material only exists at the beginning of the coking cycle, cool LRC coal briquettes are constantly being fed into the pyrolysis vessel in the coke making methods of the present invention, because of continuous operation.

Second, heat may be transferred over a short distance using LRC coal briquettes formed by methods of the present invention. Using LRC coal briquettes of the present invention and preferred size, heat must travel only about 2 cm (0.8 in) from the surface of the briquette to its core, whereas heat must travel about 20 cm (8 in) in a slot oven used in traditional coke making methods. Therefore, in specific embodiments, the LRC coal briquette is formed into a shape selected from a cube, an ovoid, a sphere, a frusta, a cylinder, and a pyramid. In a preferred embodiment, the LRC briquette will have a minor dimension of at least 30 mm, preferably at least 60 mm, and most preferably the top size recommended for a particular metallurgical use.

Third, with traditional coke making practices, the mode of principal means of heat transfer changes from conduction to radiation partway through the coking cycle. This occurs because the coal charge contracts during the coking cycle and pulls away from the furnace wall. Conduction is minimized and heat is transferred by radiation across the resulting gap. Using the pyrolysis methods of the present invention, contact is always maintained between the LRC coal briquettes and the hot surface of the pyrolysis vessel because of the gentle tumbling action that occurs as the vessel slowly rotates.

Fourth, traditional coke making practices have minimal heat transfer by convection because of the paucity of COG, especially in the later stages of pyrolysis. Convection is further hampered as the coal charge becomes compact and less permeable, which may impede the flow rate. This is in direct contrast with the convective heat transfer of the coke making methods of the present invention, in which COG is continuously generated, and a portion of that COG may be recirculated to increase velocity, a prime factor that increases the rate of heat transfer between the briquettes and hot surfaces.

Numerous laboratory and commercial scale tests of various high moisture LRCs from Indonesia, New Zealand, Australia, and North America have shown that the percentage of water removed by the briquetting processes of this invention can range up to 75% to 89% of the theoretical maximum, or 60% to 70% for subbituminous LRC. The briquetting processes described by this invention do not materially change or affect the quality or quantity of the original ash, volatiles, or molecular structure of the LRC and can deliver a dense, durable briquette that is dust free and can be custom sized and shaped to provide a premium feedstock for carbonization.

In one aspect of this invention, LRC coal briquettes are carbonized to form coke. All traditional coke making processes, including those of the present invention, use a thermal process, called pyrolysis, to remove moisture and volatile matter in the formation of coke. The amount released is dependent on the temperature and rate of heating utilized in the pyrolysis process. Water, including that in bound form is essentially removed by 150° C. (302° F.). The release of volatiles usually begins at 200° C. (392° F.) to 450° C. (842° F.) and is essentially complete at 750° C. (1,382° F.). In traditional practice, the temperature must be increased to at least 1,000° C. (1,832° F.) to form a strong mass from the devolatilized material. Advantageously, the present invention does not require this additional heating step above 750° C. (1,382° F.) because a strong mass is created when LRC coke briquettes are manufactured, by the methods of this invention.

Figure 4:
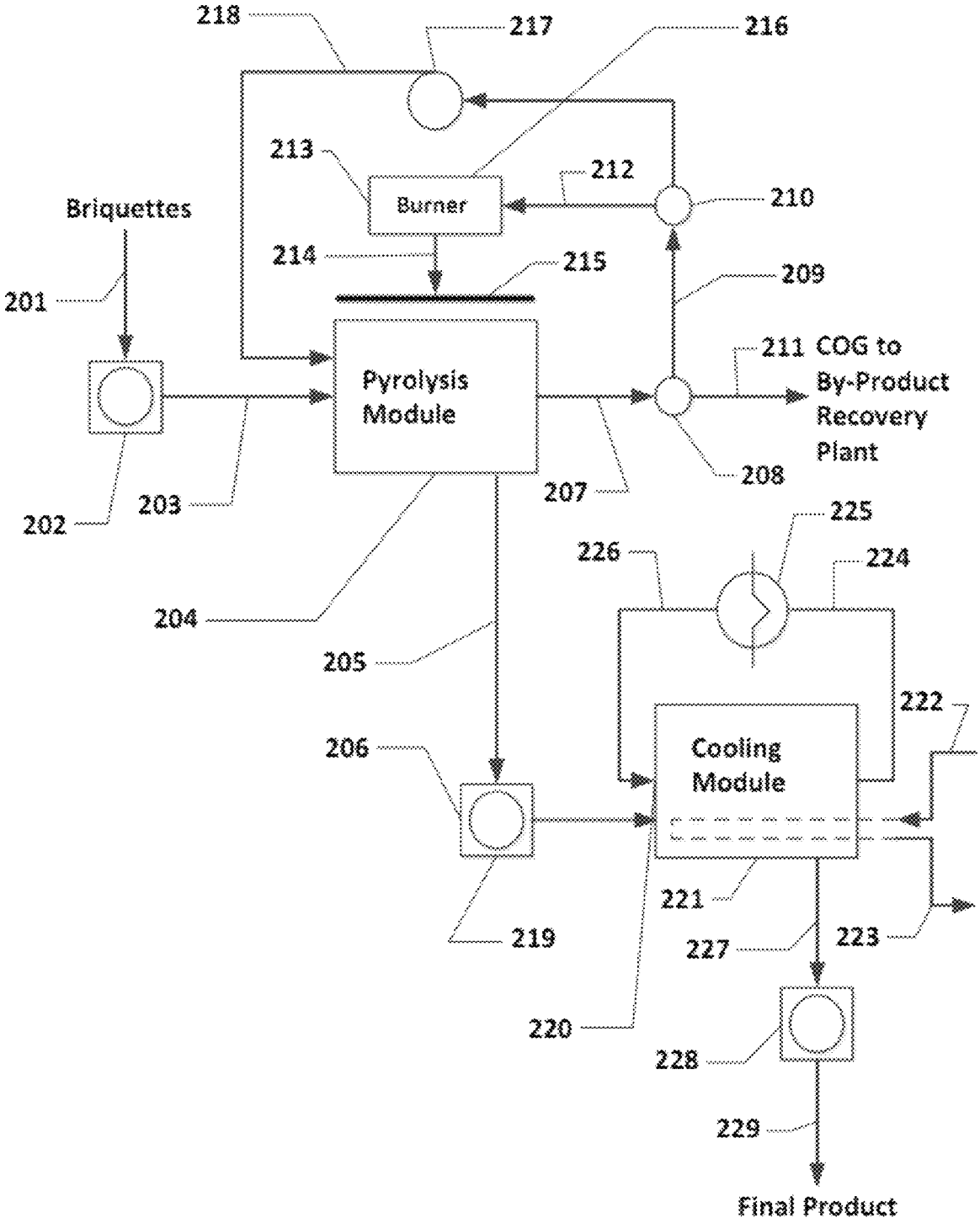
FIG. 4 describes a method of the present invention for pyrolyzing LRC briquettes to form coke.

An embodiment of the present invention, shown in FIG. 4, carbonizes LRC coal briquettes (201) that are produced by the methods described above. The LRC coal briquettes are continuously fed into a pyrolysis module (204). The pyrolysis module is indirectly heated to minimize oxygen concentration within the module, and to precisely control the heating rate along the direction of material flow. In specific embodiments, the principal method of heat transfer from the heat source to the pyrolyzed material is forced convection. In certain embodiments, the temperature gradient from the heat source to the coolest part of the pyrolyzed material is at least 200° C./cm (142° F./in), preferably 500° C./cm (354° F./in) and most preferably 1,000° C./cm (709° F./in). In these methods, the rate of heating can be controlled to change the ratio of light oils-to-gas contained in the vapors released during pyrolysis. In one embodiment of the invention, the pyrolysis module is an indirect rotary kiln. In another embodiment, the pyrolysis module is an indirect fired shaft-type kiln. In another embodiment, the pyrolysis module is a multi-hearth furnace. In a typical embodiment, the design of the pyrolysis module includes a downward-inclined cylindrical vessel that slowly rotates to tumble the LRC coal briquette feed. This attribute of the invention allows the operator of the module to control the residence time of the LRC coal briquettes in the module by adjusting the rotation speed. Additionally, the inclination of the cylindrical vessel may be designed and installed to effect a desired residence time. Typical residence times in the pyrolysis module of the present invention may be less than 10 hours, preferably the residence time may range from 30 minutes to 3 hours. More preferably, the residence time may range from 30 minutes to 2 hours. Most preferably, the residence time of the LRC coal briquettes in the pyrolysis module is about 1 hour.

In traditional coke making activities, a portion of the gas released during pyrolysis (coke oven gas or COG) is processed to recover valuable chemicals such as coal tar, ammonia, benzene, toluene, xylene, phenol, naphthalene, light oil, and sulfur. The remainder of the gas is burnt to heat the slot ovens. The quantities of valuable chemical products depend, in part, on the fuel required to heat the ovens, and the amount of volatile matter contained in the feedstock. The composition of coke oven gas (COG) depends on the rate of heating and hold time at a steady temperature. LVB coals contain between 14 wt % and 28 wt % volatile matter (VM). LRCs contain between 35 wt % and 50 wt % and the much greater amount of volatile matter contained in LRC yields substantially more recoverable chemicals, thus improving project economics (Classification of Coals by Rank, ASTM D-388; Berkowitz, N., An Introduction to Coal Technology, Academic Press, 1979, Chapter 3, FIG. 3.3.4)

In slot ovens, a considerable fraction of the COG generated during coking is burnt to create sufficient heat to pyrolyze the coal. Heat is transferred from flues through refractory walls by conduction. In turn, heat is primarily transferred from the hot walls to the coal by conduction and radiation. Forced convection, a more efficient method of transferring heat than radiation and conduction, is present when hot gas (volatile matter and its components) passes by relatively cold particles (coal). In traditional coke making methods, this efficient, convection means of transferring heat is minimal, because the only gas present is that evolved from the coal during pyrolysis. This is especially true in the traditional coke making processes when almost all volatile matter has been released as a gas before the coking cycle is complete and more heat is still required to raise the temperature of the coal material being coked to more than 1000° C. (1,832° F.). As a result of this inefficient heat transfer in the traditional coke making methods, the batch cycle is extended to 15 hours, or longer.

In the present invention, less COG is needed to heat the pyrolysis module than in a traditional slot oven because the feedstock is heated to a far lower temperature and through indirect conduction, rather than through direct conduction and radiant heat processes, thereby reserving more COG for use in recovering valuable chemicals for other uses particular to the present invention. As to the latter, in the embodiment of the present invention illustrated in FIG. 4, COG evolved during pyrolysis (207) is placed in a proportioning device (208) to maintain the proper mass flow (209) to the next proportioning device (210). Excess gas (211) may, in one embodiment of the invention, be directed to a by-product plant. Gas entering the proportioning device (210) directs the proper amount of gas (212) to the pyrolysis module burner (213) where the gas is ignited (214) to heat the exterior shell (215) to heat the pyrolysis module. Excess gas (216) not required for combustion may be drawn into an induced-draft fan (217) where the fan discharge (218) flows, under slight pressure, back to the pyrolysis module. The gas may be used to sweep LRC briquettes tumbled in the vessel to increase the rate of heat transfer by forced convection, a form of heat transfer not utilized in less efficient, traditional pyrolysis processes. The pyrolyzed product (205) is discharged as a coke briquette.

In these embodiments, the briquettes may enter and exit the pyrolysis module through one or more lock hopper devices, as illustrated in FIG. 4 (206). In the embodiments where they are used, lock hoppers ensure that the vessel is closed to the atmosphere. For example, in the embodiment illustrated in FIG. 4, the briquettes pass through a lock hopper device, a pressurized gasified chamber (202), to minimize the amount of air that is entrained with the feed (203).

As illustrated in FIG. 4, the hot product (219) discharged from the pyrolysis module is directed into a cooling module (220). In one embodiment, the cooling module contains tubes (221) cooled by a gaseous or liquid cooling medium (222). In another embodiment, the cooling module contains a cold-side induced draft fan. In such embodiments, pyrolyzed LRC briquettes are cooled by contact with the cold tubes and/or by convection of cool inert gases forced over the briquettes by the draft fan. In one embodiment of the invention, the slightly warmed cooling fluid (223) is returned to the cooling circuit. As for the inert convection gases, the warm sweep gas (224) exits the cooling module and, in another embodiment of the invention, is chilled by a shell-and-tube-style heat exchanger (225). In this embodiment, the cooled inert gas (226) is returned to the cooling module.

Similarly, the cooled LRC coke briquette (227) may exit the cooling module through a lock hopper (228). The product is discharged as an LRC coke briquette suitable for metallurgical processes (229).

Products

The briquetting and carbonization processes utilized in the present invention to produce LRC coke briquettes produce a coke product that may differ physically from the coke produced from LVBs using traditional coke-making processes. Typical values for the physical and chemical characteristics of coke produced by the methods of the present invention (i.e., LRC coke) and coke produced using LVB coal in the traditional coking processes (i.e., LVB coke) are compared in Table 1.

TABLE 1

Summary of Typical LVB and LRC Coke Qualities and Physical Properties

| Parameter | LVB | LRC |
|---|---|---|
| Total Moisture, wt % | <5.0 | <2.0 |
| Ash, wt % | 9.5-14.0 | 4-12 |
| Volatile Matter, wt % | 1.5-1.8 | 3-5 |
| Fixed Carbon, wt % | 84-89 | 82-94 |
| Sulfur, wt % | 0.3-0.8 | 0.6-.7 |
| Phosphorous, wt % | 0.02-0.006 | 0.003 |
| Coke Stability Factor (CSR) | 50-60 | 50-75 |
| Bulk density | 430-510 kg/m$^3$ (27-32 lb/ft$^3$) | 640-830 kg/m$^3$ (40-52 lb/ft$^3$) |
| Apparent Density | 800-1,100 kg/m3 (50-69 lb/ft$^3$) | 1,200-1,350 kg/m3 (75-84 lb/ft$^3$) |
| Compression Strength | 21-34 MPa (211 kg-force/cm$^2$-352 kg-force/cm$^2$) | 21-41.4 MPa (211 kg-force/cm$^2$-422 kg-force/cm$^2$) |
| Coke Strength After Reaction (CSR) | 55-60 | 50-65 |
| Processing time, hour | More than 15 | 1-3 |

As discussed above, some of these differences, including differences in the relative percentages of ash, sulfur, and phosphorous content are based upon inherent differences in the composition of LRCs and LVBs generally. However, others, such as the total moisture percentage and the fixed carbon percentage, as well as stability, bulk density, strength, apparent density, coke strength after reaction, and the processing time required to produce the coke product differ primarily due to the briquetting and carbonization processes of the present invention. These latter differences make the typical LRC coke a more durable product than the typical LVB coke. Due to the reduction in the percentage of total moisture and the increase in the percentage of fixed carbon in the LRC coke briquette versus the LVB coke product, less LRC coke may be required for metallurgical production than typically required when using LVB coke.

Traditional coke making requires that LVB coal feedstock have agglutinating properties that allow the individual particles formed during pyrolysis to adhere to one another and form a cohesive strong mass. Usually, this action occurs at high temperatures, typically above 900° C. (1,652° F.), near the end of the coking cycle. Heat treatment at the high temperature increases the mechanical strength of the coke.

LRCs do not naturally possess agglutinative effects and therefore cannot be used to make coke in the traditional way. However, processes of the present invention compact macerals intimately together. This property is retained when the LRC coal briquettes are pyrolyzed. Bonding the particles together by mechanical means provides the agglutinative properties, and this process allows for the production of LRC coke briquettes free of any binders.

Therefore, one aspect of the present invention is a LRC coke briquette devoid of any binder. Specifically, the LRC coke briquettes formed by the methods of the present invention have a high density and strength in the absence of any binders, such as coal tar, phenolic resins, pitch, asphalt, starch, bitumen, petroleum, cement, cement mixtures, lime, sulphate-containing organic binders.

In certain embodiments, the binder-free LRC coke briquettes of the invention have less than 5% total moisture. Preferably, the binder-free LRC coke briquettes of the invention have less than 1% total moisture. More preferably, the binder-free LRC coke briquettes of the invention have between about 0.01% and about 0.04% total moisture. In certain embodiments, the binder-free LRC coke briquettes of the invention have a bulk density between about 600 kg/m$^3$ (37 lb/ft$^3$) and about 850 kg/m$^3$(53 lb/ft$^3$), more preferably, between about 640 kg/m$^3$ (40 lb/ft$^3$) and about 830 kg/m$^3$(52 lb/ft$^3$). In certain embodiments, the binder-free LRC coke briquettes of the invention have an apparent density of between 1.2 g/cm$^3$ (74 lb/ft$^3$) and 2.0 g/cm$^3$(125 lb/ft$^3$) preferably between 1.3 g/cm$^3$ (81 lb/ft$^3$) and 1.7 g/cm$^3$(106 lb/ft$^3$). In certain embodiments the binder-free LRC coke briquettes of the invention may possess any one of these physical characteristics, or all of these physical characteristics.

Each publication or patent cited herein is incorporated herein by reference in its entirety.

The invention now being generally described will be more readily understood by reference to the following examples, which are included merely for the purposes of illustration of certain aspects of the embodiments of the present invention. The examples are not intended to limit the invention, as one of skill in the art would recognize from the above teachings and the following examples that other techniques and methods can satisfy the claims and can be employed without departing from the scope of the claimed invention.

EXAMPLES

Example 1

Commercial specifications for raw LVB coking coals are stated in terms of tests designed to predict the performance of the feedstock during carbonization in a coke oven battery (a group of slot ovens). The tests relate to factors such as swelling, softening, and solidification; none of which are pertinent to carbonization of LRC coal briquettes produced by the present invention.

Raw LRCs (i.e. brown coal, lignite, biomass, and low-grade subbituminous coals) exhibit diverse physical and chemical characteristics that reflect the origin and nature of the carbon content, depositional environments, and maturation processes. The physical homogeneity of coke briquettes that are derived from diverse raw LRC feedstocks using the methods of the present invention is reflected in reactions recorded during pyrolysis of Indonesian LRCs and U.S. LRCs. These types of LRCs represent a wide range of LRCs considered to date. Other types of LRCs, such as those found in Australia and New Zealand, respond in a similar manner.

Figure 7:
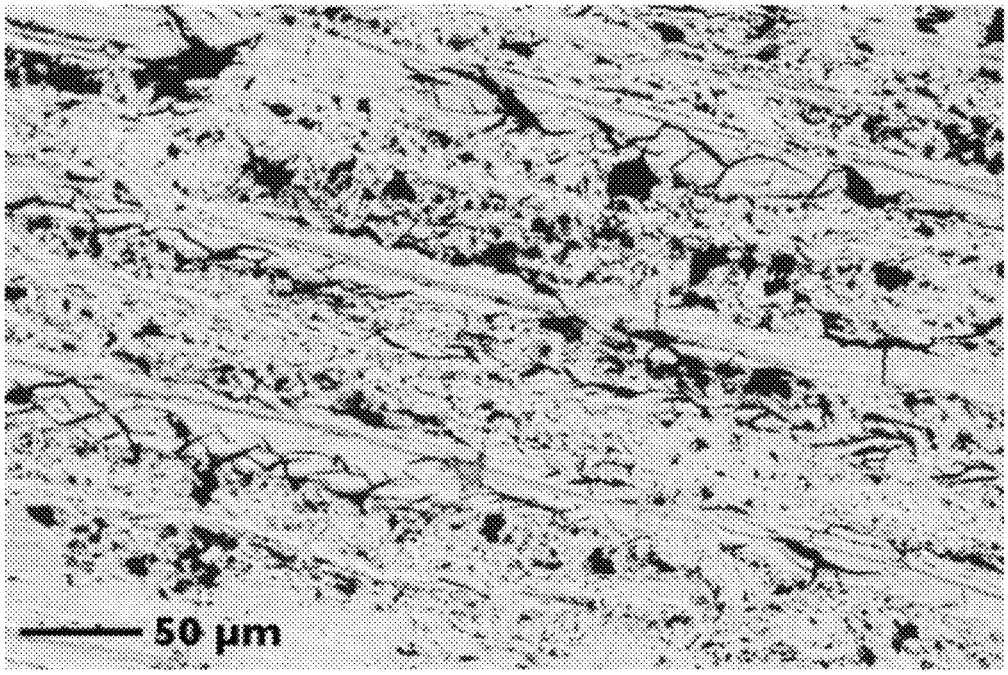
FIG. 7 depicts a sample of raw LRC of the present invention in a photomicrograph.
Figure 8:
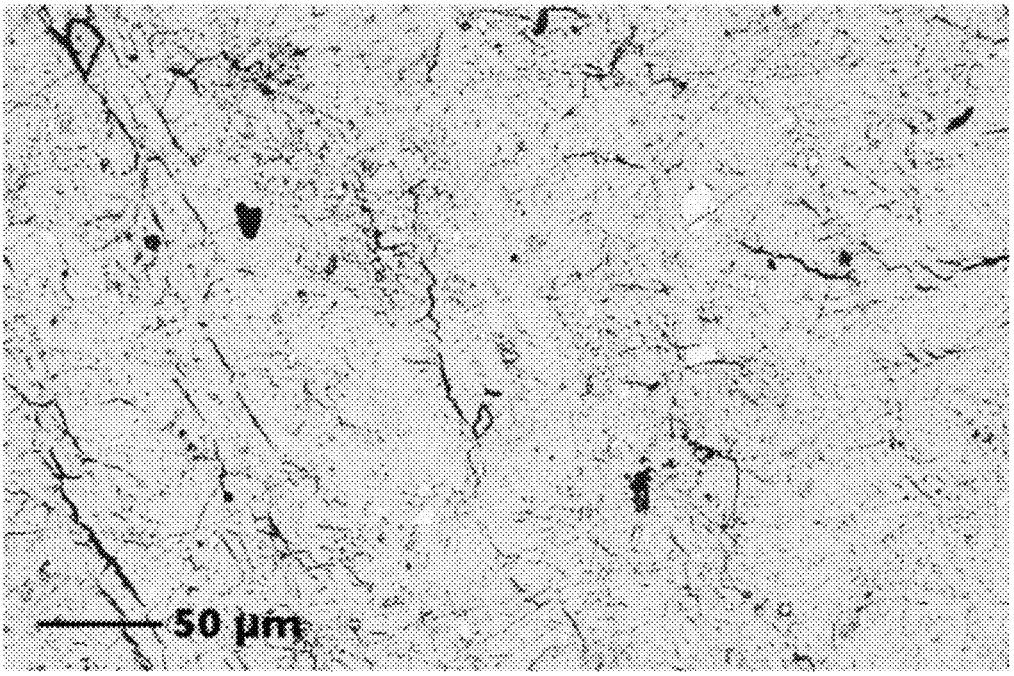
FIG. 8 depicts a sample of LRC of the present invention, after it has undergone the briquetting process.

The present invention overcomes the lack of coking characteristics in LRC by three methods: (1) destroying the macro-cellular structure of the plant matter, (2) removing typically about 80% of the total moisture and often up to 89% of the total moisture, and (3) compacting macerals to one another. FIG. 7 is a photomicrograph of raw LRC before processing by the present invention. The macropores, cellular structure of plant matter, and cracks are evident as black spaces in the photomicrograph. After processing by the present invention, the pores and cellular structure, as shown on FIG. 8, are largely eliminated. The macropores and fracture volumes are reduced up to about 89% by the present invention. As a result, most water contained in the macropores and fractured structure is expressed as a liquid, and can be evaporated at low temperature, i.e., less than about 100° C. (212° F.) and typically less than about 66° C. (149° F.). The amount of water removed depends on the characteristics of the LRC. Table 2 lists the water removal values for LRC obtained from Indonesia, Australia, New Zealand, and the U.S. Up to 80 wt % of the water, is removed, on average, in this manner. Ash and kerogen, a class of volatile matter, are not altered or released by the low-temperature drying step.

TABLE 2

Average Moisture Removal from LRC of Various Sources

| Source | Raw Total Moisture % | Briquette Total Moisture % | Removed % |
|---|---|---|---|
| Indonesia | 45.0 | 11.9 | 74 |
| New Zealand | 42.7 | 13.2 | 69 |
| United States | 32.5 | 7.0 | 79 |
| Australia | 61.0 | 12.5 | 80 |

The individual macerals and bits of plant matter that are evident in FIG. 7 are mechanically compressed at high pressure and compacted together, thus forming a cohesive and coherent mass. This action delivers a strong, stable LRC coal briquette of shape and form suitable for carbonization, and ultimate consumption, as in a blast furnace.

Example 2

Thermogravimetric analysis (TGA), a widely used technique to measure the weight loss that occurs when water and volatile matter are released when heated, was used to investigate the effects of heating LRC coal briquettes to low and high temperatures. A TGA was performed to determine the temperature required to dehydrate the coal, and second the temperatures where devolatilization starts and ends. This work guided the design and operating parameters to pyrolyze the LRC coal briquettes. TGA produces a large amount of data and graphs are the best way to present these results.

Figure 5:
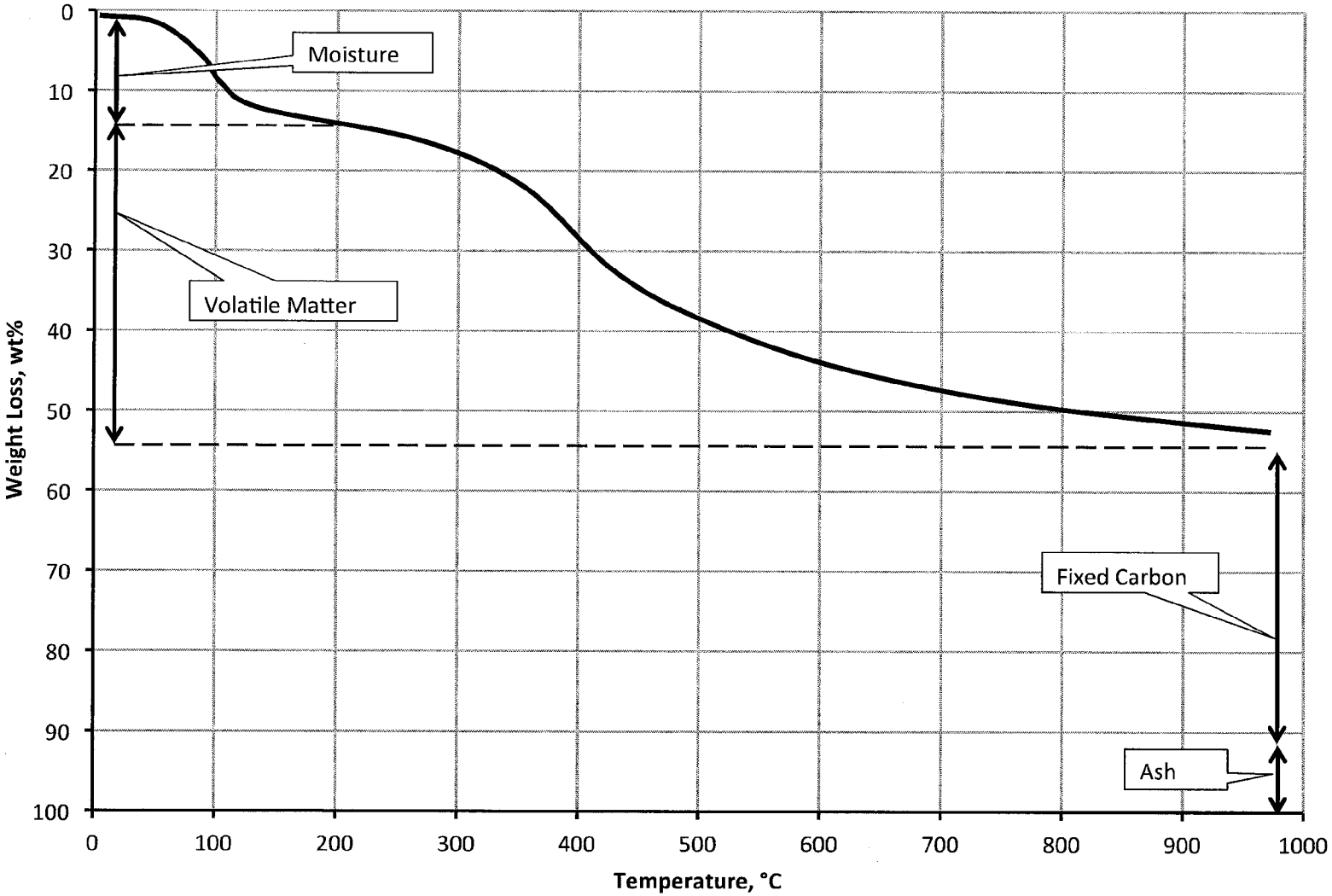
FIG. 5 describes the weight loss of a typical sample of coked LRC of the present invention over a given temperature range determined by thermogravimetric analysis.

A test was conducted using LRC from the Powder River Basin in the United States, and the data was simplified and plotted on FIG. 5 as the loss in weight as a function of temperature. Test results for U.S. LRC are typical. The shape and slope of the line was examined to determine the temperature where maximum weight loss occurs. For the U.S. LRC, the maximum rate of loss of moisture occurred at 88° C. (190° F.), and was essentially complete at 150° C. (302° F.). Devolatilization started at about 200° C. (392° F.). The maximum rate of removal occurred at 420° C. (788° F.), and was essentially complete at 750° C. (1,382° F.). At higher temperatures, calcining the ash (conversion of carbonates to oxides) and dehydrogenation accounts for the remaining weight loss.

TGA results shown on FIG. 5 also provide the moisture, volatile materials, fixed carbon, and ash contents by distinct breakpoints in the curve. In this test, the total moisture content measured at 12 wt %, volatile materials at 40 wt %, fixed carbon at 41 wt %, and ash at 7 wt %. These data are shown on the left and right sides of FIG. 5.

Figure 6:
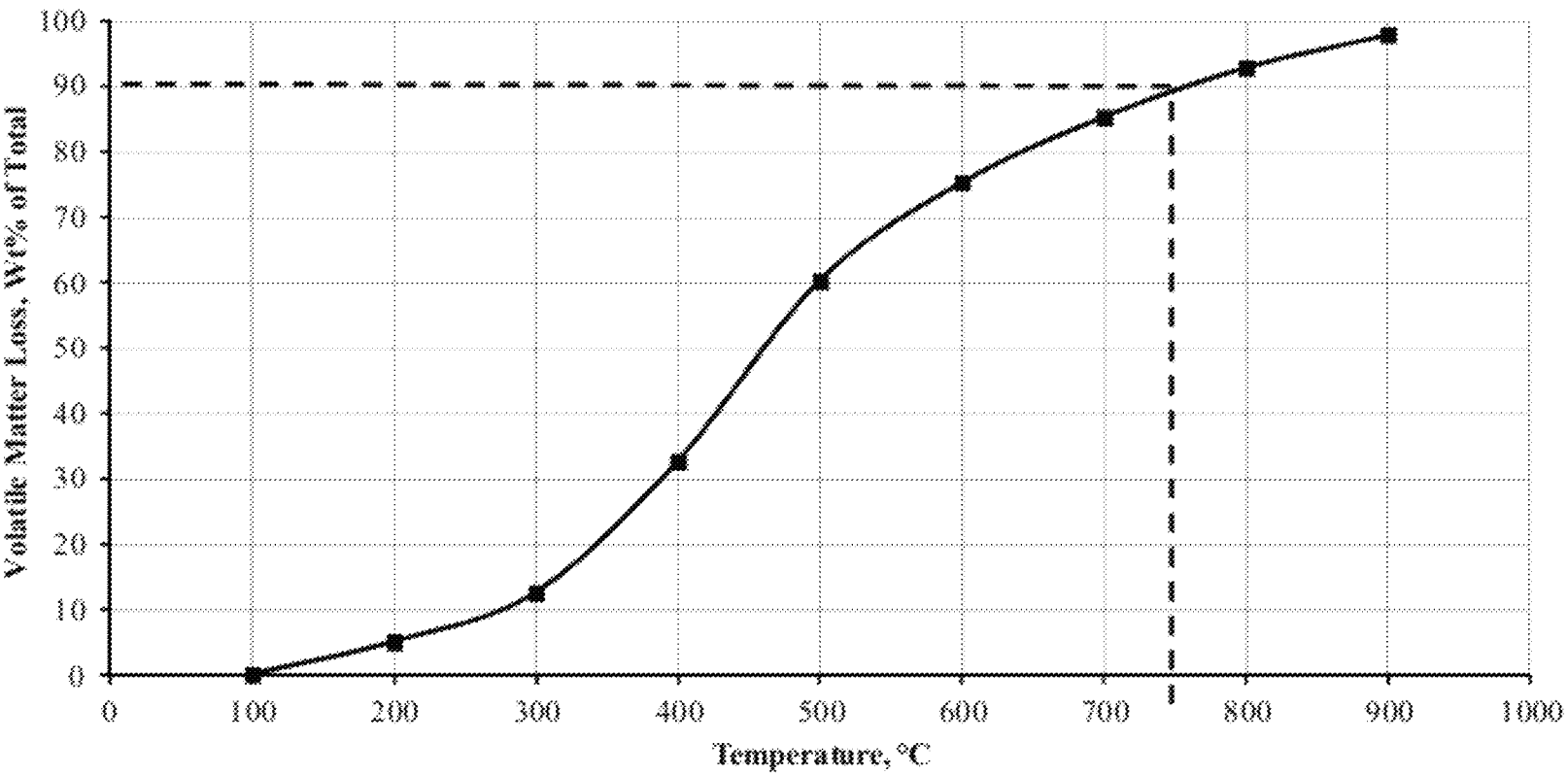
FIG. 6 describes the loss of volatile matter in a sample of coked LRC of the present invention over a given temperature range determined by thermogravimetric analysis.

FIG. 6 shows the percentage of volatile materials removed between 200° C. (392° F.) and 900° C. (1,652° F.). About 90 wt % of the volatile materials is removed below 750° C. (1,382° F.)—the preferred pyrolysis temperature of the present invention. There is a diminishing return on removing more than 90 wt % of the total volatile materials because: (1) market requirements for many grades of coke are satisfied with the product; and, (2) product yield is greater than if the LRC were to be pyrolyzed at higher temperatures.

Figure 9:
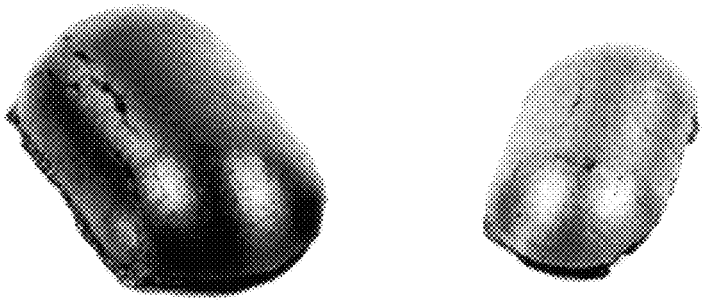
FIG. 9 depicts a sample of an LRC briquette after compacting and briquetting and an LRC briquette after coking.

Coke made from LRC briquettes maintains its shape after pyrolysis as shown in FIG. 9. However the coked briquette is smaller due to the release of water and volatile matter. The raw briquette, shown on the left side of FIG. 9, measures 50 mm long by 35 mm wide by 20 mm high (2 in by 1.4 in by 0.79 in). The coked briquette measures 34 mm long by 29 mm wide by 19 mm high (1.3 in by 1.1 in by 0.75 in). The coked briquette occupies about 53% of the volume occupied by the original briquette. The reduction in volume is about the same as the reduction in yield.

Table 3 lists the assays for LRC coal briquettes produced from Indonesian LRC and the resulting LRC coke briquettes. Table 4 lists similar data for LRC coke briquettes made from U.S. LRC coal briquettes.

TABLE 3

Assays of Indonesian LRC Coal and Coke Briquettes

| | LRC Coal Briquettes (Before Pyrolysis) | | LRC Coke Briquettes (After Pyrolysis) | |
|---|---|---|---|---|
| Parameter | Wt % AR Basis | Wt % Dry Basis | Wt % AR Basis | Wt % Dry Basis |
| Moisture | 10.36 | | 0.07 | |
| Ash | 2.59 | 2.89 | 3.70 | 3.70 |
| Volatile Matter | 48.01 | 53.56 | 2.90 | 2.90 |
| Fixed Carbon | 39.04 | 43.55 | 93.33 | 93.40 |
| Carbon | 64.57 | 72.03 | 93.77 | 93.84 |
| Hydrogen | 4.48 | 5.00 | 0.14 | 0.14 |
| Nitrogen | 0.74 | 0.83 | 0.63 | 0.63 |
| Sulfur | 0.15 | 0.17 | 0.61 | 0.61 |
| Oxygen | 17.11 | 19.09 | 1.08 | 1.08 |
| HHV, Btu/lb | 6,062 kcal/kg (10,912 Btu/lb) | 6,763 kcal/kg (12,173 Btu/lb) | 7,757 kcal/kg (13,962 Btu/lb) | 7,762 kcal/kg (13,972 Btu/lb) |
| $SiO_2$ (wt % of ash) | 29.28 | | 26.40 | |
| $Al2O_3$ | 10.33 | | 9.83 | |

TABLE 3-continued

Assays of Indonesian LRC Coal and Coke Briquettes

| Parameter | LRC Coal Briquettes (Before Pyrolysis) Wt % AR Basis | LRC Coal Briquettes (Before Pyrolysis) Wt % Dry Basis | LRC Coke Briquettes (After Pyrolysis) Wt % AR Basis | LRC Coke Briquettes (After Pyrolysis) Wt % Dry Basis |
|---|---|---|---|---|
| $TiO_2$ | 0.61 | | 0.61 | |
| $Fe_2O_3$ | 50.36 | | 51.73 | |
| CaO | 4.00 | | 4.53 | |
| MgO | 0.73 | | 0.39 | |
| $Na_2O$ | 0.37 | | 0.29 | |
| $K_2O$ | 0.38 | | 0.36 | |
| $P_2O_5$ | 0.19 | | 0.17 | |
| $SO_3$ | 4.86 | | 5.87 | |

TABLE 4

Assays of U.S. LRC Coal and Coke Briquettes

| Parameter | LRC Briquettes (Before Pyrolysis) Wt % AR Basis | LRC Briquettes (Before Pyrolysis) Wt % Dry Basis | LRC Coke Briquettes (After Pyrolysis) Wt % AR Basis | LRC Coke Briquettes (After Pyrolysis) Wt % Dry Basis |
|---|---|---|---|---|
| Moisture | 12.92 | | 0.01 | |
| Ash | 7.09 | 8.14 | 11.78 | 11.78 |
| Volatile Matter | 39.48 | 45.34 | 5.40 | 5.40 |
| Fixed Carbon | 40.51 | 46.52 | 82.81 | 82.82 |
| Carbon | 62.79 | 72.11 | 86.55 | 86.56 |
| Hydrogen | 4.09 | 4.70 | 0.16 | 0.16 |
| Nitrogen | 0.85 | 0.98 | 0.84 | 0.84 |
| Sulfur | 0.61 | 0.70 | 0.65 | 0.65 |
| Ash | 7.09 | 8.14 | 11.78 | 11.78 |
| Oxygen | 11.62 | 13.37 | 0.01 | 0.01 |
| HHV | 5,551 kcal/kg (9,993 Btu/lb) | 6,376 kcal/kg (11,476 Btu/lb) | 8,197 kcal/kg (14,754 Btu/lb) | 8,197 kcal/kg (14,754 Btu/lb) |
| $SiO_2$ (wt % of ash) | 23.93 | | 25.57 | |
| Al2$O_3$ | 15.88 | | 16.99 | |
| $TiO_2$ | 0.98 | | 0.99 | |
| $Fe_2O_3$ | 5.67 | | 6.05 | |
| CaO | 21.50 | | 23.70 | |
| MgO | 6.00 | | 3.19 | |
| $Na_2O$ | 1.47 | | 1.68 | |
| $K_2O$ | 0.47 | | 0.48 | |
| $P_2O_5$ | 0.55 | | 0.56 | |
| $SO_3$ | 21.90 | | 15.50 | |

The foregoing examples of the present invention have been presented for purposes of illustration and description. Furthermore, these examples are not intended to limit the invention to the form disclosed herein. Consequently, variations and modifications commensurate with the teachings of the description of the invention, and the skill or knowledge of the relevant art, are within the scope of the present invention. The specific embodiments described in the examples provided herein are intended to further explain the best mode known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

What is claimed is:

1. A method of producing coke comprising;

compacting a low rank coal (LRC) material in a compactor to form a compacted LRC material;

drying the compacted LRC material to remove free water and contained water from the surface of the compacted LRC material to form a dried compact; and, briquetting the dried compact in a briquetting press to form a LRC briquette, and heating the LRC briquette to a temperature between 200° C. (392° F.) and 750° C. (1,382° F.), for a time of less than 10 hours to form a coke briquette.

2. The method of claim 1, wherein the heating is indirect heating.

3. The method of claim 2, wherein the heating is performed in a continuous manner in a rotary kiln.

4. The method of claim 2, wherein the heating is performed in a continuous manner in an indirect fired shaft-type kiln.

5. The method of claim 2, wherein the heating is performed in a continuous manner in a multi-hearth furnace.

6. The method of claim 2, wherein the heating is performed in a continuous manner in a downward-inclined cylindrical vessel that slowly rotates to tumble the briquetted carbonaceous material.

7. The method of claim 6, wherein the cylindrical vessel is adjusted with respect to rotation speed allowing an operator to control residence time of the briquetted carbonaceous material in the vessel.

8. The method of claim 1, wherein the time the briquetted carbonaceous material is heated to form a coke briquette is less than 10 hours.

9. The method of claim 1, wherein the time the briquetted carbonaceous material is heated to form a coke briquette is between 0.5 hours and 2 hours.

10. The method of claim 1, wherein the time the briquetted carbonaceous material is heated to form a coke briquette is about 1 hour.

11. A method of claim 1, further comprising capturing volatile matter released from the LRC briquette during the heating step.

12. The method of claim 11, further comprising:

directing at least a portion of the captured volatile matter to a burner where the volatile matter is ignited to heat additional LRC briquettes in the heating step.

13. The method of claim 11, further comprising:

directing at least a portion of the captured volatile matter to the surface of LRC briquettes in the heating step to sweep briquettes to increase the rate of heat transfer by forced convection.

14. The method of claim 1, further comprising directing the coke briquette formed in the heating step to a cooling module.

15. The method of claim 14, wherein the cooling module contains tubes cooled by a gaseous or liquid cooling medium.

16. The method of claim 15, wherein the coke briquette is cooled by contact with at least one of contact with the cooled tubes and convection of a liquid cooling medium forced over the coke briquette.

17. The method of claim 14, wherein the cooling module contains a shell-and-tube-style heat exchanger.

18. The method of claim 1, wherein the low rank coal (LRC) is selected from brown coal, lignite, and subbituminous coal.

19. The method of claim 1, wherein the LRC briquette comprises low-ash Australian brown coal obtained from the Latrobe Valley, Victoria.

20. The method of claim 1, wherein the LRC briquette has an ash content less than 10 wt %.

21. The method of claim 1, wherein the LRC briquette has a phosphorous content less than 0.01 wt %.

22. The method of claim 1, wherein the LRC briquette has a phosphorous content less than 0.005 wt %.

23. The method of claim 1, wherein the LRC briquette comprises between 7% and 15% total moisture.

24. The method of claim 1, wherein the compactor applies a mechanical force between 352 kg-force/cm$^2$ (5,000 lbf/in$^2$) and 3,520 kg-force/cm$^2$ (50,000 lbf/in$^2$) to the LRC material to deform the feedstock to reduce the volume of pores and interstices in the LRC material and force contained water to a surface of the LRC feed material.

25. The method of claim 1, wherein the compactor applies a mechanical force of about 2,110 kg-force/cm$^2$ (30,000 lbf/in$^2$) to the LRC material to deform the feedstock to reduce the volume of pores and interstices in the LRC material and force contained water to a surface of the LRC feed material.

26. The method of claim 1, wherein the compactor comprises a roll press.

27. The method of claim 26, wherein the roll press comprises two identical counter-rotating rolls, each roll having an undulating peripheral surface, and rotating together in a timed, peak-to-valley interlocking rotation to compact the LRC material for a time longer than smooth rolls of a roller press roll design.

28. The method of claim 26, wherein a screw is used to pre-compact the LRC material into the rolls of the roll press.

29. The method of claim 1, wherein water removed from the LRC material in the compacting step is directed to a dewatering circuit by mechanical means.

30. The method of claim 1, wherein the drying of the compacted LRC material is conducted using an indirect dryer.

31. The method of claim 30, wherein the indirect dryer is an indirect rotary dryer.

32. The method of claim 30, wherein the drying of the compacted LRC material is effected by at least one of hot water, flue gas from a combustion process, steam, gas supplied from electric heaters, and waste heat available from existing industrial processes.

33. The method of claim 1, wherein the drying evaporates at least a portion of the free water contained in the compacted LRC to produce a water vapor.

34. The method of claim 1, wherein the drying of the compacted LRC material is conducted at a temperature between about 43° C. (109° F.) and about 66° C. (150° F.).

35. The method of claim 1, wherein the drying of the compacted LRC material is conducted at a temperature of about 49° C. (120° F.).

36. The method of claim 1, further comprising collecting dust and fines from the compacting, drying, and briquetting steps, and reintroducing the collected dust and fines to the LRC material in the compacting step.

37. The method of claim 1, wherein the briquetting of the dried compact is performed in a press equipped with rolls comprising a pocket design that forms a product having a shape selected from a cube, an ovoid, a sphere, a frusta, a cylinder, and a pyramid.

38. The method of claim 1, wherein the briquetting of the dried compact is performed in a press equipped with rolls comprising a pocket design that forms a product having a minor dimension between at least 30 mm (1.2 in) and 60 mm (2.4 in).

39. The method of claim 1, wherein the LRC briquette formed in the briquetting step contains between 5 wt % moisture and 15 wt % moisture.

40. The method of claim 1, wherein the LRC briquette formed in the briquetting step contains about 12 wt % moisture.

41. The method of claim 1, further comprising, prior to the compacting step:

comminuting a raw low rank coal (LRC) material in a crusher to form a crushed LRC material for compacting in the compacting step.

42. The method of claim 41, wherein the raw LRC material is not suspended in a liquid.

43. The method of claim 41, wherein the raw LRC material is not present in a slurry.

44. The method of claim 41, wherein the raw LRC is comminuted to approximately 50 mm (2 in) top size.

45. The method of claim 41, wherein the raw LRC is comminuted to a top size between about 0.2 mm (0.008 in) and about 19 mm (0.75 in).

46. The method of claim 41, wherein the raw LRC is comminuted to a top size of about 5 mm (0.2 in).

47. The method of claim 41, wherein the crusher is at least one of a hammer mill and a roll crusher.

48. The method of claim 1, further comprising, prior to the compacting step:

beneficiating a low rank coal (LRC) material in a beneficiation circuit to form an upgraded LRC material for compacting in the compacting step.

49. The method of claim 48, wherein the beneficiation circuit comprises at least one beneficiation method selected from gravity separation, ion exchange and leaching.

50. The method of claim 49, wherein the beneficiation method comprises gravity separation utilizing at least one of a concentrating table, a jig, a spiral concentrator, a heavy media cyclone, and a heavy media vessel.

51. The method of claim 49, wherein the beneficiation method comprises introducing a gravity control reagent to the LRC material.

52. The method of claim 49, wherein the beneficiation method comprises introducing magnetite to the LRC material.

53. The method of claim 49, wherein the beneficiation method comprises ion exchange to reduce sodium in the LRC material.

54. The method of claim 53, wherein the ion exchange comprises at least one reagent selected from calcium hydroxide, calcium carbonate, and flue gas desulfurization sludge.

55. The method of claim 49, wherein the beneficiation method comprises a leaching circuit that reduces at least one of sodium, ash, sulfur, and combinations thereof from the LRC material.

56. The method of claim 55, wherein the leaching circuit comprises at least one reagent selected from sulfuric acid, hydrochloric acid, nitric acid, acetic acid, and a sodium hydroxide solution.

57. A method of producing a coke briquette comprising:

comminuting a raw low rank coal (LRC) material in a crusher to form a crushed LRC material;

compacting the LRC material in a compactor to form a compacted LRC material;

drying the compacted LRC material to remove free water and contained water from the surface of the compacted LRC material to form a dried compact;

briquetting the dried compact in a briquetting press to form a LRC briquette; and, heating the LRC briquette to a temperature between 200° C. (392° F.) and 750° C. (1,382° F.) for a time of less than 10 hours to form a coke briquette.

* * * * *